US005998349A

United States Patent [19]

Guillou

[11] Patent Number: 5,998,349

[45] Date of Patent: Dec. 7, 1999

[54] DESCALING AND CLEANING COMPOSITIONS CONTAINING CELLULOSE MICROFIBRILS

[75] Inventor: Veronique Guillou, Asnieres, France

[73] Assignee: Rhodia Chimie, Courbevoie, France

[21] Appl. No.: 09/051,152

[22] PCT Filed: Jul. 31, 1996

[86] PCT No.: PCT/FR96/01206

§ 371 Date: Apr. 2, 1998

§ 102(e) Date: Apr. 2, 1998

[87] PCT Pub. No.: WO97/12954

PCT Pub. Date: Apr. 10, 1997

[30] Foreign Application Priority Data

Oct. 3, 1995 [FR] France ..... 95 11697

[51] Int. Cl.[6] ..... C11D 3/22; C11D 3/382

[52] U.S. Cl. ..... 510/249; 510/250; 510/253; 510/462; 510/473

[58] Field of Search ..... 510/249, 250, 510/253, 344, 462, 473; 252/180

[56] References Cited

U.S. PATENT DOCUMENTS

| | | | |
|---|---|---|---|
| 1,360,254 | 11/1920 | Aisen | 510/462 |
| 1,378,931 | 5/1921 | Adler | 510/180 |
| 1,554,483 | 9/1925 | Bailey et al. | 134/28 |
| 1,576,985 | 3/1926 | Moore | 510/139 |
| 1,736,800 | 11/1929 | Rathje | 510/248 |
| 2,225,294 | 2/1940 | Belton et al. | 507/277 |
| 3,277,008 | 10/1966 | Heit | 510/253 |
| 3,440,170 | 4/1969 | De Hek | 510/253 |
| 4,629,575 | 12/1986 | Weibel | 507/214 |
| 4,831,127 | 5/1989 | Weibel | 536/56 |
| 4,957,599 | 9/1990 | Chou et al. | 162/78 |

FOREIGN PATENT DOCUMENTS

| | | | |
|---|---|---|---|
| 0 666 306 A1 | 2/1994 | European Pat. Off. | C11D 3/20 |

*Primary Examiner*—Yogendra Gupta
*Assistant Examiner*—Christine Ingersoll
*Attorney, Agent, or Firm*—John Daniel Wood; Jean-Louis Seugnet

[57] ABSTRACT

The invention relates to a descaling formulation comprising cellulose microfibrils, in which at least 80% of the cells have primary walls and not more than 20% of the cells have secondary walls, with a degree of crystallinity of not more than 50%. The pH of the formulation is less than or equal to 1 and more particularly less than or equal to 0.5.

17 Claims, No Drawings

DESCALING AND CLEANING COMPOSITIONS CONTAINING CELLULOSE MICROFIBRILS

This application is an application under 35 U.S.C. Section 371 of International Application Number PCT/FR96/01206, filed on Jul. 31, 1996.

The present invention relates to descaling and cleaning formulations based on cellulose microfibrils.

Detergent formulations used for descaling have quite specific characteristics. Thus, the products forming part of its composition must be capable of remaining stable and of retaining their properties at very acidic pH levels, which are mostly less than 2 and quite often less than 1. Moreover, it is very desirable for the rheology of the formulations to be of the pseudoplastic type. The reason for this is that, for optimum use, these formulations must have a low viscosity when they are subjected to high shear, as is the case during application of the product, followed by a high viscosity when the shear strains are low, so as to allow slow running down the walls to be descaled.

Current formulations are based on a mixture of surfactants representing up to 10% of the weight of the formulation. However, formulations of this type are not entirely satisfactory, in the sense that the rheological behaviour is not pseudoplastic but newtonian. Furthermore, such formulations are relatively expensive since the amount of surfactant is very large.

Standard thickeners such as polysaccharides have been tested in media whose pH is less than 1, but without great success. The reason for this is that these products are not very stable in such media and increasingly degrade the lower the pH.

The aim of the present invention is to propose a descaling formulation with a pseudoplastic rheological profile, which is stable over time.

Thus, the subject of the invention is a descaling formulation comprising cellulose microfibrils, in which at least 80%, preferably at least 85%, of the cells have primary walls and not more than 20%, preferably not more than 15%, of the cells have secondary walls, with a degree of crystallinity of not more than 50%, preferably not more than 40%.

However, other characteristics and advantages of the present invention will become more apparent on reading the description and the examples which follow.

Thus, it has been found that the microfibrils mentioned above give the formulation a rheology of pseudoplastic nature and, moreover, that these microfibrils, surprisingly, remain stable and retain their properties in very acidic media, i.e. media whose pH is between 0 and 1.

The microfibrils forming part of the composition of the formulations according to the invention thus consist of cellulose.

Cellulose represents the essential component of plant cell walls. These walls consist of primary walls (parenchymal cells) and secondary walls, in various proportions depending on the nature of the plant from which they are obtained. The primary walls mainly comprise certain pectins and proteins and little cellulose, generally about 5%, and depend on the growth of the cell. The fibrils in the secondary walls consist of networks forming lamellae in which is found a layer $S_1$ (thickness of 0.2 to 0.35 $\mu$m) comprising very entangled and spiralled microfibrils, a layer $S_2$ (thickness of 1.8 to 3.8 $\mu$m) based essentially on cellulose in a very compact, oriented form, and whose relatively unentangled microfibrils form concentric lamellae, and, lastly, a layer $S_3$ (thickness of 0.1 to 0.15 $\mu$m) based on entangled and spiralled cellulose fibres.

The microfibrils used as additives in the formulations according to the invention have at least 80%, preferably at least 85%, of cells with primary walls and not more than 20%, preferably not more than 15%, of cells with secondary walls.

In addition, the cellulose microfibrils have an average diameter of between 20 and 40 Å, preferably between 30 and 40 Å.

As has been mentioned previously, the degree of crystallinity of the microfibrils is not more than 50%, preferably not more than 40%. More particularly, the degree of crystallinity is between 20 and 38%.

The length of these microfibrils is about 10 $\mu$m and less. Microfibrils less than or equal to 2 $\mu$m in length can be used more particularly.

More particularly, the cellulose microfibrils are obtained from beetroot, from cereal bran or from any other plant.

The cellulose microfibrils are of high purity, of about 90%. The remaining 10% consist mainly of residual compounds such as water, pectins, for instance galacturonic acid, rhamnose or ferulic acid, hemicelluloses, for instance arabinose, galactose, mannose and xylose, and mineral salts.

These microfibrils can be obtained by extraction via standard routes. Preferably, they can be obtained according to a process described below, using a treatment carried out on primary-wall plant pulp such as, for example, beetroot pulp after it has undergone a step of preextraction of sucrose, according to the known methods of the art. The said process comprises the following steps:

(a) first acidic or basic extraction, after which a first solid residue is recovered, (b) optionally, second extraction, carried out under alkaline conditions, of the first solid residue, after which a second solid residue is recovered, (c) washing of the first or second solid residue, (d) optionally, bleaching of the washed residue, (e) dilution of the third solid residue obtained after step (d) so as to obtain a solids content of between 2 and 10% by weight, (f) homogenization of the dilute suspension.

In step (a), the term "pulp" is understood to refer to wet or dehydrated pulp, stored by ensilage or partially depectinized.

The extraction step (a) can be carried out in acidic medium or in basic medium.

For an acidic extraction, the pulp is suspended in an aqueous solution for a few minutes so as to homogenize the suspension acidified to a pH of between 1 and 3, preferably between 1.5 and 2.5.

This operation is carried out with a concentrated solution of an acid such as hydrochloric acid or sulphuric acid.

This step can be advantageous for removing the crystals of calcium oxalate which may be present in the pulp and which, on account of their highly abrasive nature, can cause difficulties in the homogenization step.

For a basic extraction, the pulp is added to an alkaline solution of a base, for example sodium hydroxide or potassium hydroxide, with a concentration of less than 9% by weight, more particularly less than 6% by weight. Preferably, the concentration of the base is between 1 and 2% by weight.

A small amount of a water-soluble antioxidant such as sodium sulphite, $Na_2SO_3$, may be added in order to limit the oxidation reactions of the cellulose.

Step (a) is generally carried out at a temperature of between about 60° C. and 100° C., preferably between about 70° C. and 95° C.

The duration of step (a) is between about 1 hour and about 4 hours.

During step (a), partial hydrolysis takes place with release and solubilization of most of the pectins and hemicelluloses, while at the same time conserving the molecular mass of the cellulose.

The solid residue is recovered from the suspension obtained from step (a) by carrying out known methods. Thus, it is possible to separate the solid residue by centrifugation, by filtration under vacuum or under pressure, with filtering gauzes or filter presses, for example, or alternatively by evaporation.

The first solid residue obtained is optionally subjected to a second step of extraction, carried out under alkaline conditions.

A second step of extraction is carried out when the first step has been performed under acidic conditions. If the first extraction was carried out under alkaline conditions, the second step is merely optional.

According to the process, this second extraction is carried out with a base preferably chosen from sodium hydroxide and potassium hydroxide, whose concentration is less than about 9% by weight, preferably between about 1% and about 6% by weight.

The duration of the alkaline extraction step is between about 1 and about 4 hours. It is preferably equal to about 2 hours.

After this second extraction, where necessary, a second solid residue is recovered.

In step (c), the residue obtained from step (a) or (b) is washed thoroughly with water in order to recover the residue of cellulose material.

The cellulose material from step (c) is then optionally bleached, in step (d), according to the standard methods. For example, a treatment with sodium chlorite, with sodium hypochlorite or with hydrogen peroxide, in a proportion of 5–20% relative to the amount of solids treated, can be carried out.

Various concentrations of bleaching agent can be used, at temperatures of between about 18° C. and 80° C., preferably between about 50° C. and 70° C.

The duration of this step (c) is between about 1 hour and about 4 hours, preferably between about 1 hour and about 2 hours.

A cellulose material containing between 85 and 95% by weight of cellulose is thus obtained.

After this bleaching step, it may be preferable to wash the cellulose thoroughly with water.

The resulting, optionally bleached suspension is then rediluted in water at a rate of 2 to 10% solids.

The homogenization step corresponds to a mixing, grinding or any operation of high mechanical shear, followed by passing the cell suspension one or more times through an orifice of small diameter, subjecting the suspension to a pressure drop of at least 20 MPa and to a high-speed shear action, followed by a high-speed deceleration impact.

The mixing or grinding is, for example, carried out by passing the suspension (one or more times) through a mixer or grinder for a period ranging from a few minutes to about one hour, in a machine such as a Waring Blendor equipped with a four-blade impeller or a mixing-pan mill or any other type of grinder, such as a colloidal grinder.

The actual homogenization will advantageously be carried out in a Manton Gaulin type homogenizer in which the suspension is subjected to a shear action at high speed and pressure in a narrow passage and against an impact ring. Mention may also be made of the Micro Fluidizer, which is a homogenizer mainly consisting of a compressed-air motor which creates very high pressures, an interaction chamber in which the homogenization operation will be carried out (elongational shear, impacts and cavitations) and a low-pressure chamber which allows depressurization of the dispersion.

The suspension is introduced into the homogenizer preferably after preheating to a temperature of between 40 and 120° C., preferably between 85 and 95° C.

The temperature of the homogenization operation is maintained between 95 and 120° C., preferably above 100° C.

The suspension is subjected in the homogenizer to pressures of between 20 and 100 MPa and preferably greater than 50 MPa.

Homogenization of the cellulose suspension is obtained by a number of passages which can range between 1 and 20, preferably between 2 and 5, until a stable suspension is obtained.

The homogenization operation can advantageously be followed by an operation of high mechanical shear, for example in a machine such as the Ultra Turrax machine from Sylverson.

It should be noted that this process has been described in European patent application number 96 400261.2 filed on Jul. 2, 1996, and reference may thus be made thereto if necessary.

The amount of microfibrils forming part of the composition of the formulation according to the invention is between 0.05 and 1.5% by weight. Preferably, this amount is between 0.1 and 1% by weight.

Here and for all of the rest of the description, unless specifically mentioned otherwise, the weight percentages are expressed as weight of material (for example the microfibrils) relative to the total weight of the formulation.

The formulation according to the invention moreover comprises an acidic compound. This compound may be organic or inorganic.

Any organic acid is suitable provided that its pKa is less than or equal to 6. More particularly, mention may be made of aliphatic mono- or polycarboxylic acids comprising from 1 to 12 carbon atoms.

By way of example of acids of this type, mention may be made of formic acid, acetic acid, maleic acid, citric acid, sulphamic acid, oxalic acid, adipic acid, succinic acid or glutaric acid.

It should be noted that it would not constitute a departure from the scope of the present invention to use one or more of the acids mentioned. Thus, for example, mixtures of citric acid and formic acid are suitable for carrying out the invention, as is the so-called "AGS" mixture, which is a by-product of the Nylon manufacturing line and comprises adipic acid, glutaric acid and succinic acid in the following proportions: 15 to 30% succinic acid, from 50 to 75% glutaric acid and from 5 to 25% adipic acid.

All the inorganic acids conventionally used in detergency are suitable. By way of example and with no intention of being limited thereto, mention may be made of hydrochloric acid, phosphoric acid or mixtures thereof.

Needless to say, it is possible to use a mixture of acids belonging to the two categories, if they are compatible.

The amount of acid forming part of the composition of the formulation is such that the pH of the final formulation is less than or equal to 2, more particularly less than 1.5.

According to a preferred embodiment of the invention, the amount of acid used is such that the pH of the formulation is less than or equal to 1 and more particularly less than or equal to 0.5.

Given what has just been stated hereinabove, a person skilled in the art is capable of adapting the amount of acid to be used depending on the characteristics of the acid(s) envisaged. However, as a guide, the amount of acid in the formulation is between 1 and 20% by weight. More particularly, it is between 3 and 15% by weight.

The formulation according to the invention also comprises at least one detergent surfactant. In general, this compound is chosen from nonionic, cationic or amphoteric surfactants.

All surfactants are suitable provided that they are stable in media with a pH of less than 2.

By way of example of nonionic surfactants, mention may be made of polyoxyalkylenated alkylphenols in which the alkyl substituent is $C_6$–$C_{12}$ and contains from 5 to 25 oxyalkylene (oxyethylene, oxypropylene or oxybutylene) units, polyoxyalkylenated alkylarylphenols in which the alkyl substituent is $C_1$–$C_6$ and comprises 5 to 25 oxyalkylene (oxyethylene or oxypropylene) units, polyoxyalkylenated $C_8$–$C_{22}$ aliphatic alcohols containing from 1 to 25 oxyalkylene (oxyethylene or oxypropylene) units, and the products resulting from the condensation of ethylene oxide or propylene oxide with propylene glycol, ethylene glycol and/or glycerol.

Still by way of nonionic surfactants, mention may be made of glucosamides, glucamides, glycerolamides, products resulting from the condensation of ethylene oxide or propylene oxide with ethylenediamine, amine oxides such as $C_{10}$–$C_{18}$alkyl dimethylamine oxides, $C_8$–$C_{22}$alkoxy ethyldihydroxyethylamine oxides, the alkylpolyglycosides described in U.S. Pat. No. 4,565,647, $C_8$–$C_{20}$ fatty acid amides, ethoxylated fatty amides and ethoxylated amines.

According to a specific embodiment of the invention, polyoxyalkylenated aliphatic alcohols and polyoxyalkylenated alkylphenols are preferably used, these surfactants being used alone or as a mixture.

Among the alkylphenols, compounds having 1 or 2 linear or branched alkyl groups having 4 to 12 carbon atoms, in particular octyl, nonyl or dodecyl groups, are used more particularly.

The ethoxylated (EO units) or ethoxypropoxylated (EO+PO units) alkylphenols generally have 1 or 2 linear or branched alkyl groups having 4 to 12 carbon atoms, in particular octyl, nonyl or dodecyl groups.

By way of examples of surfactants of this type, mention may be made most particularly of nonylphenol ethoxylated with 6 EO units, nonylphenol ethoxylated with 9 EO units, nonylphenol ethoxylated with 10 EO units, nonylphenol ethoxylated with 12 EO units, nonylphenols ethoxypropoxylated with 25 EO+PO units, nonylphenols ethoxypropoxylated with 30 EO+PO units and nonylphenols ethoxy-propoxylated with 40 EO+PO units.

By way of cationic surfactants which can form part of the formulation according to the invention, quaternary ammoniums are suitable for carrying out the invention.

More particularly, and without any intention of being limiting, mention may be made of alkyltrimethylammonium, dialkyldimethylammonium, alkyldimethylbenzylammonium and alkyldimethylethylammonium halides, Quat esters, and benzalkonium chloride such as the products Rhodaquat®.

The surfactants forming part of the formulation according to the invention can also be chosen from amphoteric surfactants. By way of example, alkylbetaines, alkyldimethylbetaines, alkylamidopropylbetaines, alkylamidopropyldimethylbetaines, alkyltrimethylsulphobetaines, imidazoline derivatives such as alkyl amphoacetates, alkyl amphodiacetates, alkyl amphopropionates, alkyl amphodipropionates, alkylsultaines or alkylamidopropylhydroxysultaines or the condensation products of fatty acids with protein hydrolysates may be mentioned, it being possible for these compounds to be used alone or as a mixture.

The surfactants Mirapon® Excel, Mirataine® CBS, Mirataine® CB, the Miranol® range, Amphionic® SFB and Amphionic® XL may be suitable in particular for carrying out the present invention.

It is clear that it would not constitute a departure from the scope of the present invention to prepare a formulation comprising one or more surfactants chosen from identical or different categories, provided that they are compatible.

The amount of surfactants is between 0.1 and 5% by weight. Preferably, it is between 0.8 and 3% by weight.

The formulation according to the present invention can also comprise standard additives for this particular type of application. Thus, the formulations can contain dyes, fragrances or preserving agents.

Usually, the content of additives is less than 2% by weight, or even less than 1% by weight. In fact, the content of these compounds depends on the effect to be obtained and this is often achieved with contents as low as 0.1 to 0.2% by weight.

The remainder to 100w by weight of the formulation consists of water.

The process for the preparation of the formulation according to the invention will now be described.

The process may be carried out according to the standard methods in this field. Thus, the various constituent components of the formulation are placed in contact, in any order, simultaneously or successively, in a machine for homogenizing the mixture.

However, according to a specific embodiment of the invention, the cellulose microfibrils are first dispersed in at least some of the water forming part of the formulation.

Needless to say, this operation is carried out with stirring.

It is important to note that the viscosity properties of the formulation can be adapted according to the quality of stirring. Thus, when the stirring is slow, i.e. at a speed of less than 1000 rev/min, the viscosity of the resulting formulation is lower than the viscosity of a formulation obtained with the same amount of microfibrils, but prepared with vigorous stirring, for example at greater than 5000 rev/min. Consequently, more vigorous stirring will make it possible to decrease the amount of microfibrils needed to obtain the desired level of viscosity.

The machines with which the formulation is prepared are standard and are, in particular, machines of the Ultra-Turrax® type, machines with deflocculating or mixing blades.

Once the aqueous dispersion of the cellulose microfibrils has been obtained, the acid or the mixture of acids is added, followed by the detergent surfactant(s) and lastly the additive(s).

If the final viscosity of the formulation is insufficient, it is possible to add an additional amount of microfibrils.

The stirring of the first step, that of the dispersion of the microfibrils in water, may or may not be retained, since it is possible to disperse the microfibrils with vigorous stirring and then to reduce this stirring during the introduction of the other components of the formulation.

The preparation of the formulation is usually carried out at room temperature.

The formulations according to the invention can be applied in particular to the descaling of sanitary appliances both in the domestic and institutional (community) sectors.

Concrete but non-limiting examples of the invention will now be given.

EXAMPLES

Examples 1a and 1b

The aim of these examples is to show the influence of the process implemented on the viscosity of the microfibril suspension.

A suspension comprising an amount of cellulose microfibrils in an aqueous solution comprising 10% hydrochloric acid is prepared, so as to obtain a pH of 0.

These cellulose microfibrils were supplied by Générale Sucrière; they were prepared according to Example 20 of European patent application 96 400261.2 filed on Feb. 7, 1996.

Example 1a consists in suspending the microfibrils using a deflocculating paddle-stirrer, at a speed of 1400 revolutions/min.

Example 1b consists in suspending the microfibrils using an Ultra-Turrax machine, at a speed of 500 revolutions/min.

The viscosities were measured with a Brookfield machine (needle No. 3).

The table below collates the results obtained:

| | Amount of | Viscosity (MPa · s) | | |
|---|---|---|---|---|
| Example | microfibrils | 10 rev/min | 20 rev/min | 50 rev/min |
| 1a | 0.42% | 900 | 490 | 250 |
| 1b | 0.85% | 720 | 440 | 210 |

It is observed that the same level of viscosity can be obtained with half the amount of microfibrils, by increasing the stirring shear and speed.

Example 2

The aim of this example is to evaluate the viscosity of a microfibril suspension with a pH of 2.

The suspension comprises 0.8% microfibrils and was obtained by stirring with a deflocculating paddle-stirrer rotating at 500 revolutions/min.

The viscosities, measured with a Brookfield machine (needle No. 2), are as follows:

0.3 revolutions/mm 7200 MPa.s 3 revolutions/min 1000 MPa.s 30 revolutions/min 770 MPa.s

What is claimed is:

1. A descaling formulation, comprising a) between 0.05 and 1.5% by weight of cellulose microfibrils having at least 80% of cells with primary walls and not more than 20% of cells with secondary walls, and having a degree of crystallinity of less than 50%, b) an acidic compound, the amount of acid being such that the pH of the formulation is less than or equal to 2, c) at least one detergent surfactant in an amount of between 0.1 and 5% by weight, and d) water to 100% by weight of the formulation.

2. A descaling formulation according to claim 1, comprising cellulose microfibrils having at least 85% of cells with primary walls and not more than 15%, of cells with secondary walls, and having a degree of crystallinity of less than 40%.

3. A descaling formulation according to claim 1, wherein the microfibrils have an average diameter of between 20 and 40 Å.

4. A descaling formulation according to claim 1, wherein the microfibrils are obtained from primary-wall plant pulp.

5. A descaling formulation according to claim 4, wherein the microfibrils are obtained from beetroot or from cereal bran.

6. A descaling formulation according to claim 1, further comprising one or more organic or inorganic acids.

7. A descaling formulation according to claim 6, wherein the organic acid is an aliphatic mono- or polycarboxylic acid having 1 to 12 carbon atoms.

8. A descaling formulation according to claim 7, wherein the organic acid is formic acid, acetic acid, maleic acid, citric acid, sulphamic acid, oxalic acid, adipic acid, succinic acid or glutaric acid.

9. A descaling formulation according to claim 6, wherein the inorganic acid is hydrochloric acid or phosphoric acid.

10. A descaling formulation according to claim 6, wherein the amount of acid is such that the pH is less than 0.5.

11. A descaling formulation according to claim 6, wherein the amount of acid is between 1 and 20% by weight.

12. A descaling formulation according to claim 1, further comprising one or more nonionic, cationic or amphoteric detergent surfactants.

13. A descaling formulation according to claim 11, further comprising dyes, preserving agents or fragrances.

14. A descaling formulation according to claim 13, wherein the content of additives is less than 2%.

15. A process for descaling and for cleaning a surface, comprising the step of applying to said surface a composition as defined in claim 1.

16. A descaling formulation, comprising:

a) between 0.05 and 1.5% by weight of cellulose microfibrils made by the process of:

1) carrying out a first acidic or basic extraction on a primary-wall plant pulp, 2) recovering a first solid residue, 3) optionally, carrying out under alkaline conditions a second extraction on the first solid residue obtained in step 2), 4) optionally, recovering a second residue, 5) washing the first and, optionally, the second residue, 6) optionally, bleaching the residue obtained in step 5), 7) diluting the residue obtained in step 6) so as to obtain a suspension with a solids content of between 2 and 10% by weight, and 8) homogenizing the dilute suspension of step 7), said microfibrils having at least 80% of cells with primary walls and not more than 20% of cells with secondary walls, and having a degree of crystallinity of less than 50%, b) an acidic compound, the amount of acid being such that the pH of the formulation is less than or equal to 2, c) at least one detergent surfactant in an amount of between 0.1 and 5% by weight, and d) water to 100% by weight of the formulation.

17. A process for descaling and for cleaning a surface, comprising the step of applying to said surface a composition as defined in claim 16.

* * * * *